US005727652A

United States Patent [19]

Ho

[11] Patent Number: 5,727,652

[45] Date of Patent: Mar. 17, 1998

[54] DEVICE FOR DRAINING ENGINE OIL

[76] Inventor: Ying-Chen Ho, No. 30-2, Lane 294, Tzu Wen Rd.,, Tao-Yuan City, Taiwan

[21] Appl. No.: 819,737

[22] Filed: Mar. 18, 1997

[51] Int. Cl.[6] ..... F16C 3/14

[52] U.S. Cl. ..... 184/1.5; 251/294; 251/144

[58] Field of Search ..... 184/1.5; 251/294, 251/144; 141/98

[56] References Cited

U.S. PATENT DOCUMENTS

| | | | |
|---|---|---|---|
| 1,995,174 | 3/1935 | Gerrard et al. | 184/1.5 |
| 3,477,459 | 11/1969 | Schossow | 184/1.5 |
| 3,871,483 | 3/1975 | Espinosa et al. | 251/294 |
| 3,954,250 | 5/1976 | Grace | 251/144 |
| 4,086,981 | 5/1978 | Mitsui | 184/1.5 |
| 4,905,643 | 3/1990 | DeGrazia, Jr. | 184/1.5 |
| 4,907,676 | 3/1990 | Shirdavani | 251/294 |

*Primary Examiner*—Thomas E. Denion
*Attorney, Agent, or Firm*—Morton J. Rosenberg; David I. Klein; Jun Y. Lee

[57] ABSTRACT

A device for draining engine oil in a DIY manner including an oil drain screw bolt, a valve, an oil drain tube, a spring element, and a control cable. The screw bolt has a cylindrical rod portion having a drain hole at the center, and a head portion having an oil outlet at one side communicating with the drain hole. The outer end of the oil outlet forms a threaded section of a larger diameter. The head portion is provided with a through hole in a direction perpendicular to the oil outlet. The valve is provided with a rod at a front end for receiving a spring. A front end of the rod is connected to a pull strap. The valve is locked in the through hole of the screw bolt by a sunk-head screw. The oil drain tube has a rotary connecting portion at a front end for locking in the threaded section of the oil outlet. A control valve is provided at a rear end of the oil drain tube. The control cable forms a hook portion at a front end thereof and is passed through a small duct at one side of the oil drain tube. Engine oil may be drained using the device, without the need to remove the screw bolt from the engine.

1 Claim, 6 Drawing Sheets

DEVICE FOR DRAINING ENGINE OIL

BACKGROUND OF THE INVENTION (a) Field of the Invention

The present invention relates generally to an engine oil draining device, and more particularly to a device for draining engine oil in a DIY fashion.

(b) Description of the Prior Art

Engine oil must be changed regularly in order to keep the engine of the vehicle in good conditions. However, in draining engine oil, it is necessary to raise the vehicle so that the oil drain screw bolt at the bottom rim of the engine may be taken down. As most car owners do not have elevating or lifting apparatus, they have to leave such maintenance job to car shops. As oil draining and refilling has to be done on a regular basis, and the cost of maintenance is high, it is a burden to many car owners. In order to save expenses, some car owners do the maintenance themselves. They slip under the car frame to remove the screw bolt from the engine to drain the oil and then refill new engine oil. But such job is not easy for women although it is more economical.

In addition, there is available on the market a kind of oil sucker which eliminates the need to remove the oil drain screw bolt. The oil sucker is used to suck up oil in the engine via the oil hole. However, the dirty particles collected at the bottom of the engine cannot be removed using such a device. If new engine oil is added before the dirty particles are removed, the service life and performance of the engine will be affected.

SUMMARY OF THE INVENTION

Accordingly, a primary object of the present invention is to provide a device for draining engine oil in a DIY manner whereby it is not necessary to lift up the car to remove the oil drain screw bolt.

Another object of the present invention is to provide a device for draining engine oil in a DIY manner whereby engine oil may be drained off economically and easily.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
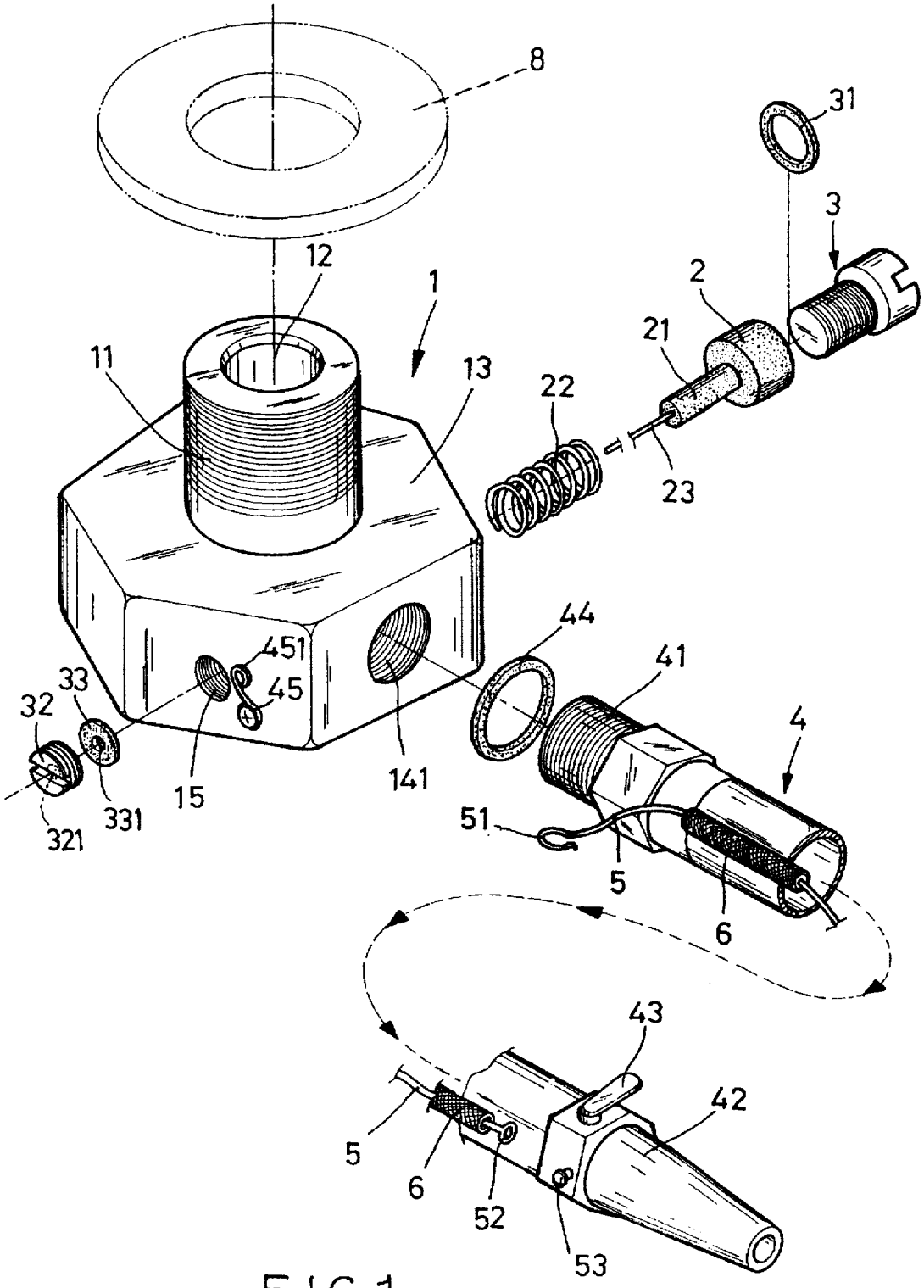
FIG. 1 is an elevational exploded view of the structure of the present invention.

With reference to FIGS. 1–6, the present invention essentially comprises an oil drain screw bolt 1, a valve 2, an oil drain tube 4, a spring element 45, and a control cable 5.

The oil drain screw bolt 1 has a cylindrical rod portion 11 the diameter and height of which are the same as those of existing oil drain screw bolts. The screw bolt 1 is provided to lock onto an oil drain hole 71 at an engine bottom rim 7. The rod portion 11 is provided with an drain hole 12 at the center. Furthermore, a head portion 13 of the screw bolt 1 is laterally provided with an oil outlet 14 communicating with the drain hole 12 of the rod portion 11 such that they form an L-shaped passage. The outer end of the oil outlet 14 is configured to form a thread section 141 of a larger diameter. Additionally, the head portion 13 is provided with a through hole 15 in a direction perpendicular to the oil outlet 14. The rear end of the through hole 15 forms a narrower portion, and an oil seal 151 is disposed at the inner wall the narrow portion.

The valve 2 is provided with a rod 21 at a front end thereof for fitting a spring 22 thereon. The front end of the rod 21 in turn is connected to a pull strap 23. By means of a sunk-head screw 3 fitting through a packing ring 31, the valve 2 may be locked inside the through hole 15 of the oil drain screw bolt 1. The rear end of the through hole 15 is locked by means of a small sunk-head screw 31 and a packing ring 33, both of which have a small central hole 321, 331 for passage of the pull strap 23.

The oil drain tube 4 has a rotary connecting portion 41 at a front end thereof for locking within the threaded section 141 of the oil outlet 14. An outlet 42 at the rear end of the oil drain oil tube 2 is provided with a control valve 43. Besides, the connecting portion 41 is fitted with a packing ring 44.

The spring element 45 is locked at outlet side of the through hole 15 with an end portion 451 connected to the strap extending from the through hole 15.

The control cable 5 forms a hook portion 51 at a front end thereof, which may connect the end portion 451 of th spring element 5. A rear end thereof is provided with a pull ring 52. Furthermore, the control cable 5 is passed through a small duct 6 secured at a lateral side of the oil drain tube 4 for positioning purposes.

Figure 2:
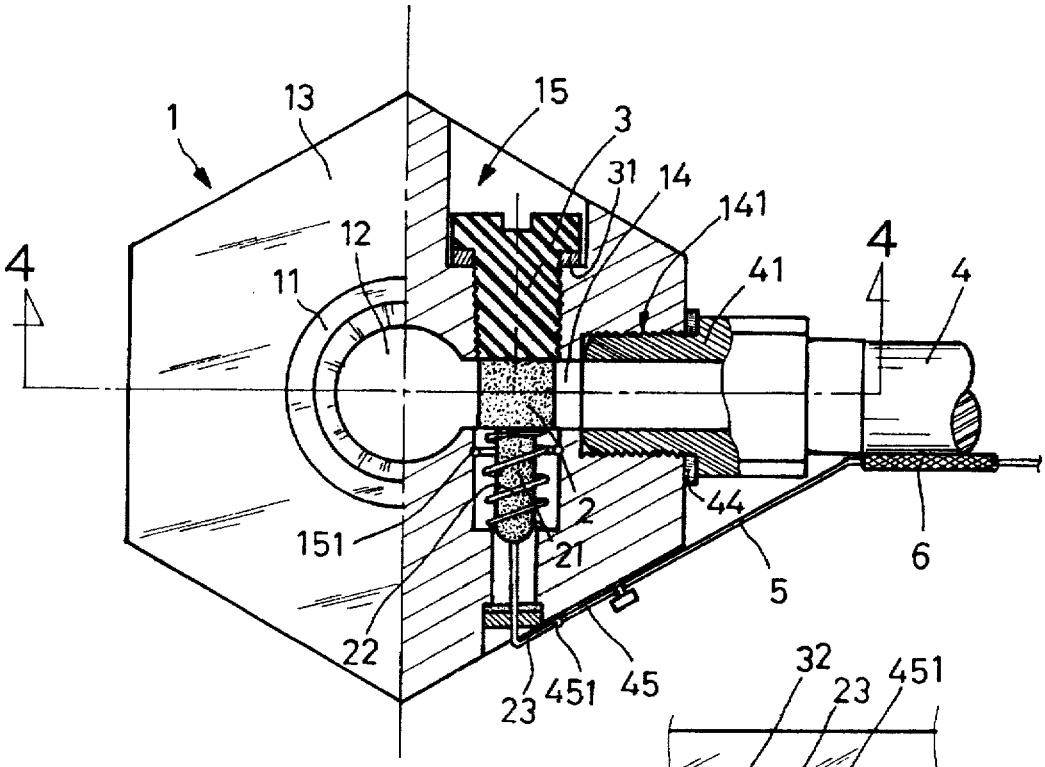
FIG. 2 is a sectional view of the structure of the present invention, showing the oil outlet in a closed state.
Figure 6:
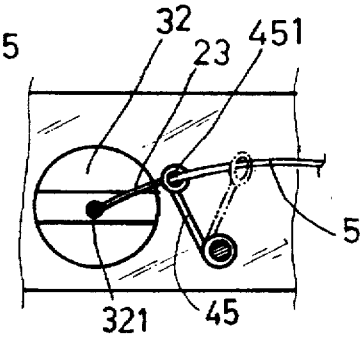
FIG. 6 is a sectional view taken along line 6—6 of FIG. 3.
Figure 3:
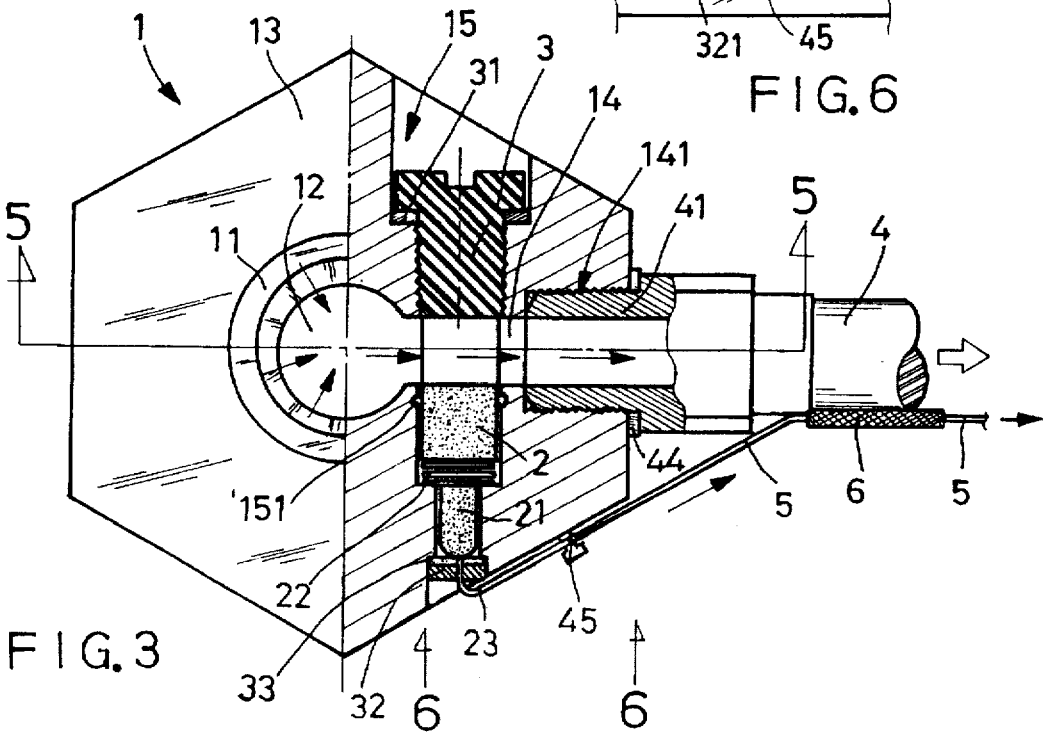
FIG. 3 is a sectional view of the structural of the present invention, showing the oil outlet in an opened state.
Figure 4:
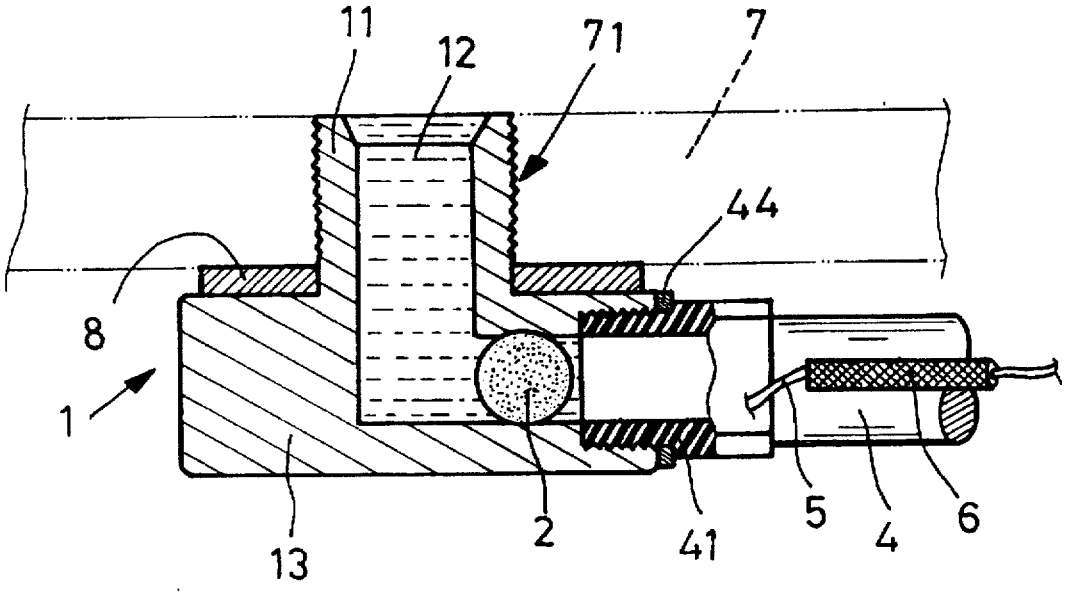
FIG. 4 is a sectional view taken along line 4—4 of FIG. 2.

The structure and use of the present invention thus assembled is now described with reference to FIGS. 2–5. In FIGS. 2 and 4, the oil outlet 14 is shown to be in a closed state whereas in FIGS. 3 and 5, the oil outlet 14 is shown to be in an opened state. The screw bolt 1 is fitted through a packing ring 8 and locked to the oil drain hole 71 of the engine bottom rim 7, while the oil drain tube 4 is locked in the oil outlet 14 by means of the rotary connecting portion 41 at the front end thereof, thus defining an oil drain path. The valve 2 is locked in the through hole 15 by use of the sunk-head screw 3. At this point, by means of the action of the spring 22 at the outer periphery of the rod 21, the valve 2 is just located on the oil outlet 14 to shut it off. Therefore, the oil drain screw bolt 1 of the present invention has essentially the same functions as conventional ones at ordinary times. When it is required to refill new engine oil, referring to FIGS. 3 and 5, it is only necessary to pull the control cable 5 so as to force the valve 2 to compress the spring 22 so that the valve 2 disengage from the oil outlet 14. Oil is therefore drained via the oil drain tube 4. After the old engine oil has been drained off, the control cable 5 is released so that the valve 2 returns to its original position by means of the spring 22 and shuts off the oil outlet 14. The user may then refill new engine oil.

Figure 5:
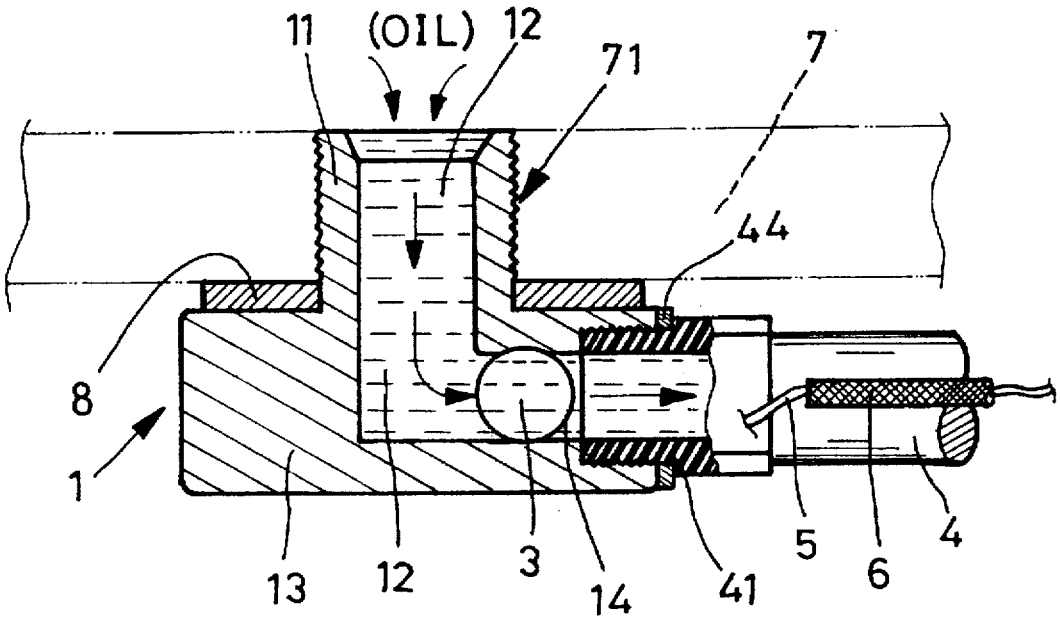
FIG. 5 is a sectional view taken along line 5—5 of FIG. 3.
Figure 7:
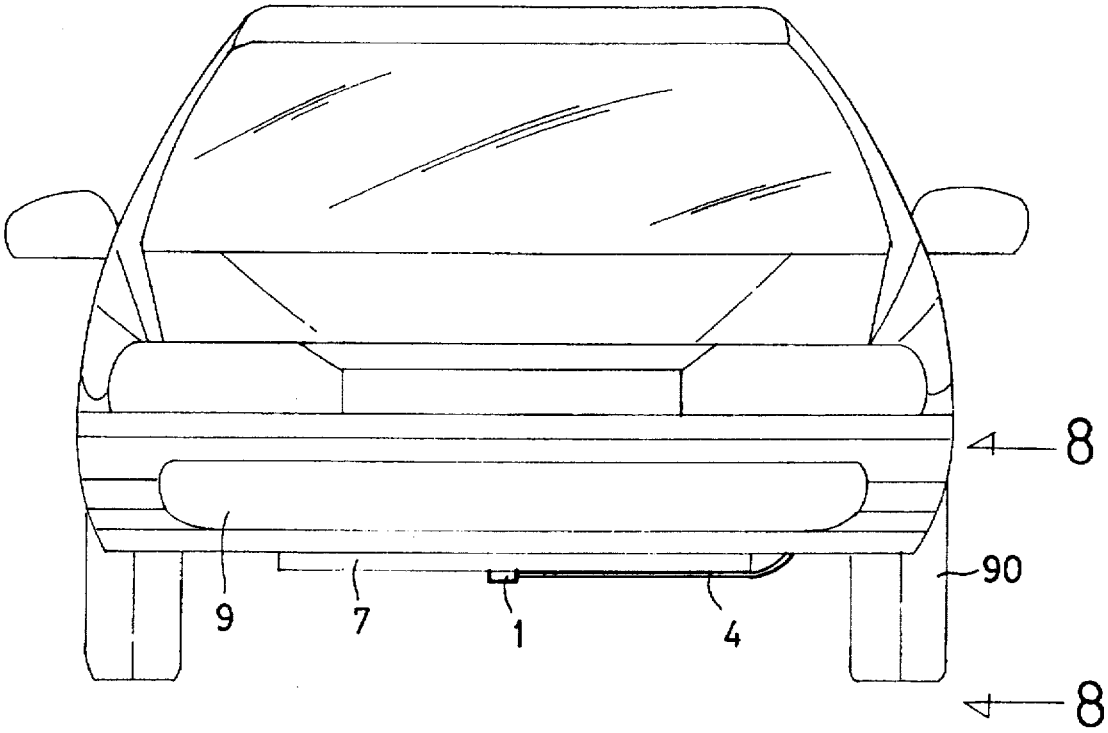
FIG. 7 is a schematic view showing the present invention in use.
Figure 8:
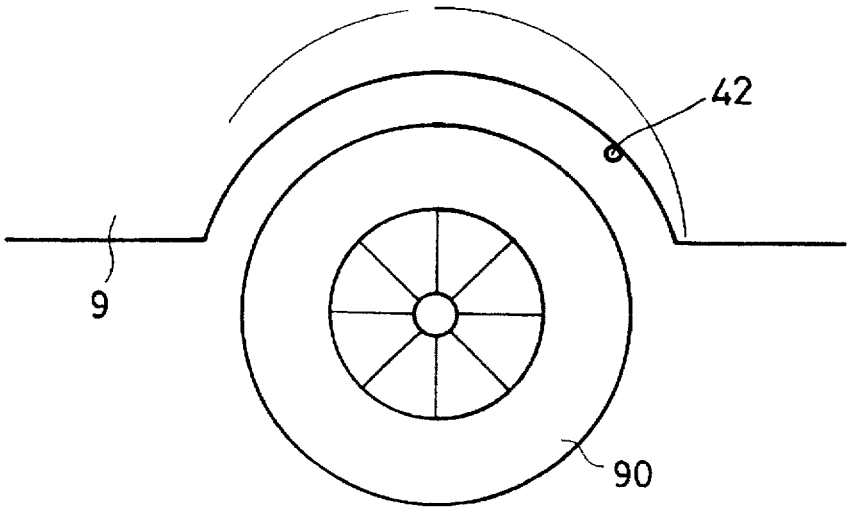
FIG. 8 is a directional view of FIG. 7.
Figure 9:
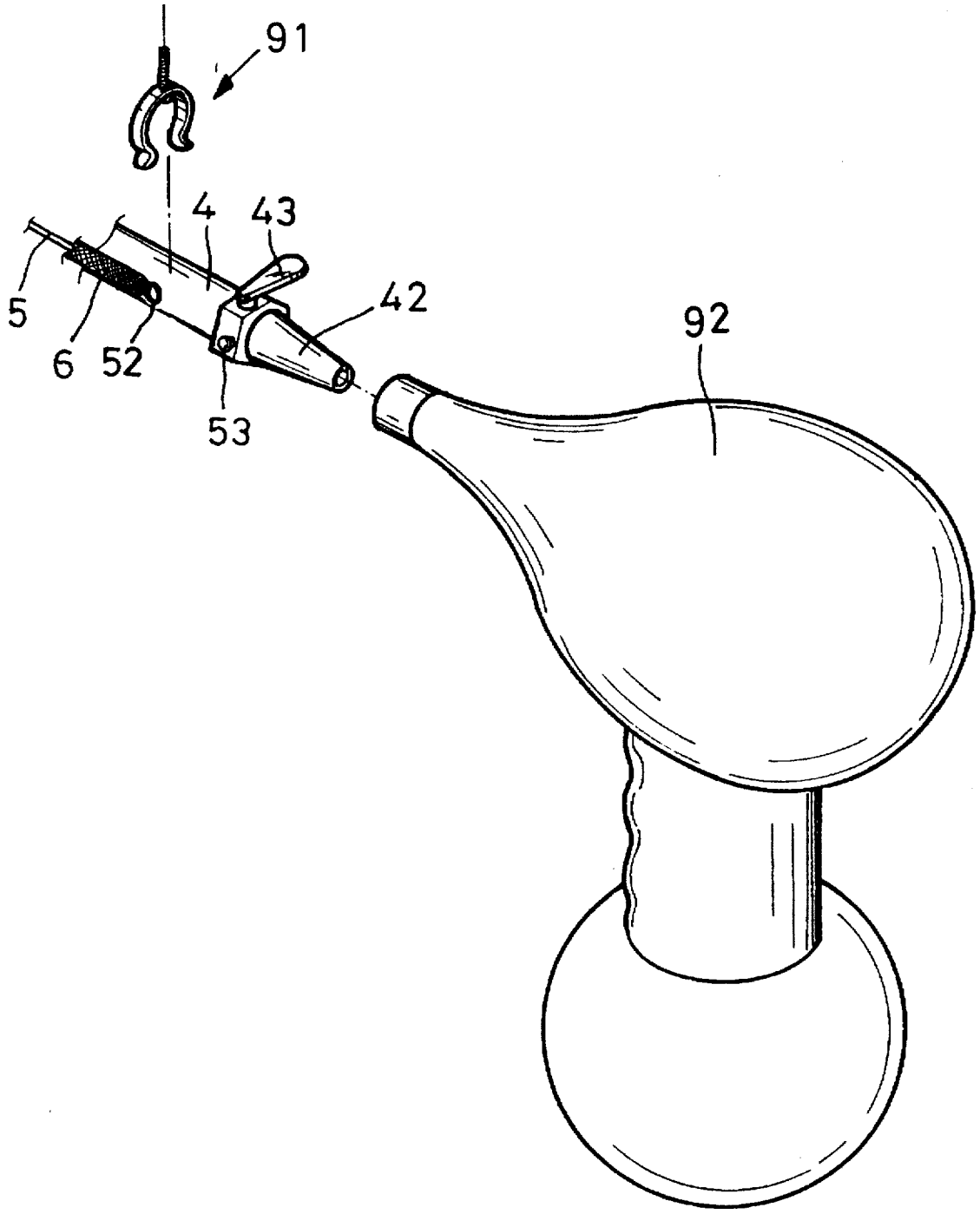
FIG. 9 is a schematic view showing a sucker device of the present invention.

As shown in FIGS. 7 and 8, the oil drain tube 4 may be arranged according to models. In these figures, the oil drain tube 4 runs along the engine bottom rim 7 to the upper side of a tire 90 at the side of the vehicle 9 and is secured in position at a position convenient to the user. Referring to FIG. 9, the rear end 42 of the oil drain tube 4 is clamped in position by means of a fastening element 91 locked to the vehicle. When it is required to drain the engine oil, the user may just pull the pull ring 52 of the control cable so that it is held by a stop member 53 at one side of the control valve 3. Then, as shown in FIGS. 3 and 5, valve 2 displaces away from the oil outlet 14 so that the engine oil flows via the oil drain tube 4 and drains off through the outlet 42 at the rear end. At this point, by opening the control valve 43 again, the engine oil may be smoothly drained into a collecting bucket 93. When the oil engine oil has been drained, there may be some residual engine oil inside the oil drain tube 4 or the bottom side of the engine. The present invention further provides a sucker 92 which may be used to suck the residual oil via the outlet 42 of the oil drain tube 4 so as to completely remove the old engine oil.

Furthermore, after the oil has been completely drained off, the control cable 5 is released and pulled back by the spring element 45. Then the valve 2 will close the oil outlet 14 again.

Figure 10:
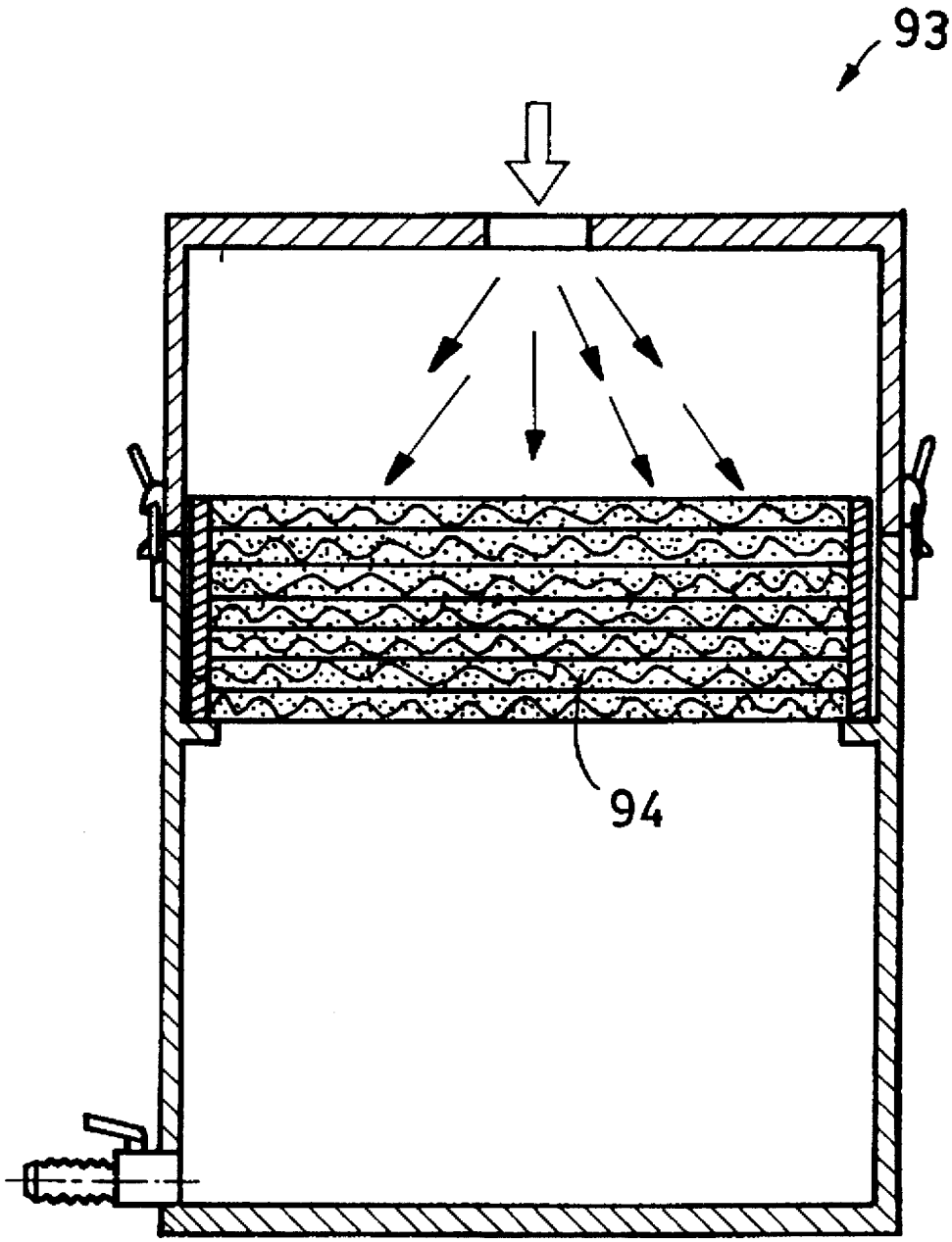
FIG. 10 is a schematic view showing an oil collecting bucket of the present invention.

In addition, referring to FIG. 10, the collecting bucket 93 is provided with a filter device 94 at the center for filtering off particles in the engine oil so that the used engine oil may be recycled. The filter device 94 is replaceable.

The effects achievable by the present invention are further described below:

1. The oil drain screw bolt 1 of the present invention is connected to the oil drain tube 4 running to the side of the vehicle 9 so that the user does not need to slip under the vehicle 9 or to elevate the vehicle 9 to drain the engine oil. It is therefore time—and labor-saving. Such DIY maintenance can be done regularly and economically.
2. Maintenance of vehicles equipped with the oil drain screw bolt 1 and oil drain tube 4 of the present invention may have also be done at ordinary car shops. If the technician needs to speed up oil drain, he may remove the rotary connecting portion 41 of the oil drain tube 4 from the oil drain screw bolt 1, and disengage the hook portion 51 of the control cable 5 from the end portion 451 of the spring element 45. The technician may then remove the screw bolt 1 from the oil drain hole 71 of the engine. In this way, the screw bolt of the present invention has the same functions as conventional ones.

Although the present invention has been illustrated and described with reference to the preferred embodiment thereof, it should be understood that it is in no way limited to the details of such embodiment but is capable of numerous modifications within the scope of the appended claims.

What is claimed is:

1. A device for draining engine oil, comprising:

an oil drain screw bolt having a cylindrical rod portion with a drain hole at the center, and a head portion, said head portion having an oil outlet formed at one side communicating with said drain hole to form a substantially L-shaped passage, an outer portion of said oil outlet forming a threaded section of a larger diameter, said head portion further having a through hole in a direction perpendicular to said oil outlet, a narrower portion being formed at a rear end of said through hole, and an oil seal being provided at an inner wall of said narrower portion;

a valve having a rod at a front end thereof, said rod being fitted with a spring, a front end of said rod being connected to a pull strap, said valve being locked inside said through hole of said oil drain screw bolt by means of a sunk-head screw fitting through a packing ring, a rear end of said through hole being locked by use of a small sunk-head screw and a packing ring, both of which have a small hole in the middle for passage of said pull strap;

an oil drain tube having a rotary connecting portion at a front end thereof for locking in said threaded portion of said oil outlet, a control valve being provided at a rear end of said oil drain tube, and said rotary connecting portion being fitted with a packing ring;

a spring element locked at an outer end of said through hole, said spring element having an end portion connected to said pull strap extending from said through hole; and a control cable having a hook portion at a front end thereof for connecting said end portion of said spring element, said control cable further having a pull ring at a rear end thereof, said control cable being passed through a small duct secured at one side of said oil drain tube to be positioned thereby; whereby engine oil may be completely drained off without the need to remove said oil drain screw bolt from the bottom rim of the engine of a vehicle.

* * * * *